United States Patent [19]

Chadabe

[11] Patent Number: 4,526,078

[45] Date of Patent: Jul. 2, 1985

[54] INTERACTIVE MUSIC COMPOSITION AND PERFORMANCE SYSTEM

[75] Inventor: Joel Chadabe, P.O. Box 8748, Albany, N.Y. 12208

[73] Assignee: Joel Chadabe, Albany, N.Y.

[21] Appl. No.: 421,900

[22] Filed: Sep. 23, 1982

[51] Int. Cl.[3] ..... G10F 1/00

[52] U.S. Cl. ..... 84/1.03; 84/1.01; 84/1.24; 84/1.19

[58] Field of Search ..... 84/1.03, 1.24, DIG. 12, 84/1.01, 1.19, 1.27

[56] References Cited

U.S. PATENT DOCUMENTS

| | | | |
|---|---|---|---|
| 4,108,035 | 8/1978 | Alonso | 84/1.01 |
| 4,148,239 | 4/1979 | Oya et al. | 84/1.24 |
| 4,170,916 | 10/1979 | Fritz et al. | 84/1.24 |
| 4,195,545 | 4/1980 | Nishimoto | 84/1.26 |
| 4,231,276 | 11/1980 | Ando et al. | 84/1.19 |
| 4,281,574 | 8/1981 | Deutsch | 84/1.19 |
| 4,294,155 | 10/1981 | Turner | 84/1.03 |
| 4,339,978 | 7/1982 | Imamura | 84/1.03 |
| 4,341,140 | 7/1982 | Ishida | 84/1.03 |
| 4,399,731 | 8/1983 | Aoki | 84/1.03 |
| 4,468,998 | 9/1984 | Baggi | 84/1.03 |

OTHER PUBLICATIONS

Mathews with Abbott, "The Sequential Drum", Computer Music Journal, vol. 4, No. 4, Winter 1980, pp. 45–59.

Interactive Composing: An Overview, Joel Chadabe, 1983.

M. V. Mathew, "The Conductor Program".

M. V. Mathews et al., Computers and Future Music, SCIENCE, Jan. 25, 1974, pp. 263–268.

S. Martirano, "Progress Report #1".

Lejaren Hiller, Music by Computers, H. von Foerster et al., eds., 1969, pp. 71–83.

Neuhaus, "Inventors", People Magazine, May 10, 1982.

Kobrin, Music Performance, Feb. 1977.

*Primary Examiner*—Forester W. Isen

*Attorney, Agent, or Firm*—Curtis, Morris & Safford

[57] ABSTRACT

An interactive music composition and performance system is a real-time composing and sound-producing system which employs a synthesizer, a programmable computer, and at least one performance device and which functions automatically to generate controls which determine the course of the musical composition it plays as well as the nature of the sound it produces. The system is interactive in that a user can direct aspects of the system's production of music, as he or she hears it being produced, by use of a performance device. If the user does not provide an input, the system proceeds automatically to compose music and produce sound.

14 Claims, 7 Drawing Figures

FIG. 5
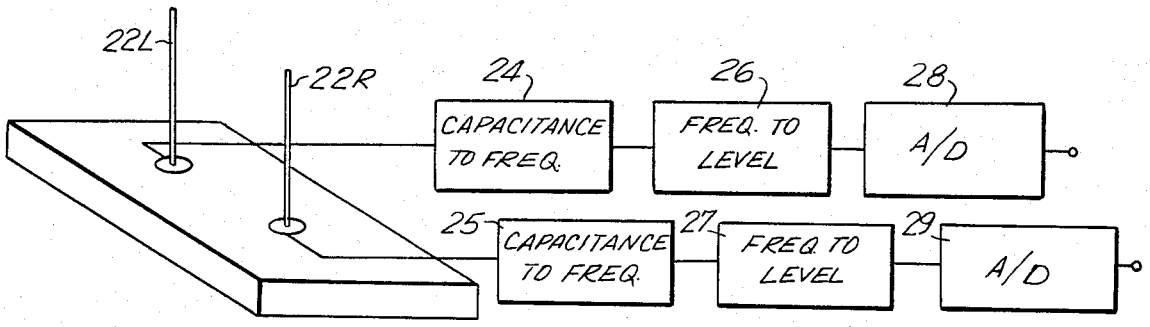
HAND-PROXIMITY INPUT DEVICE
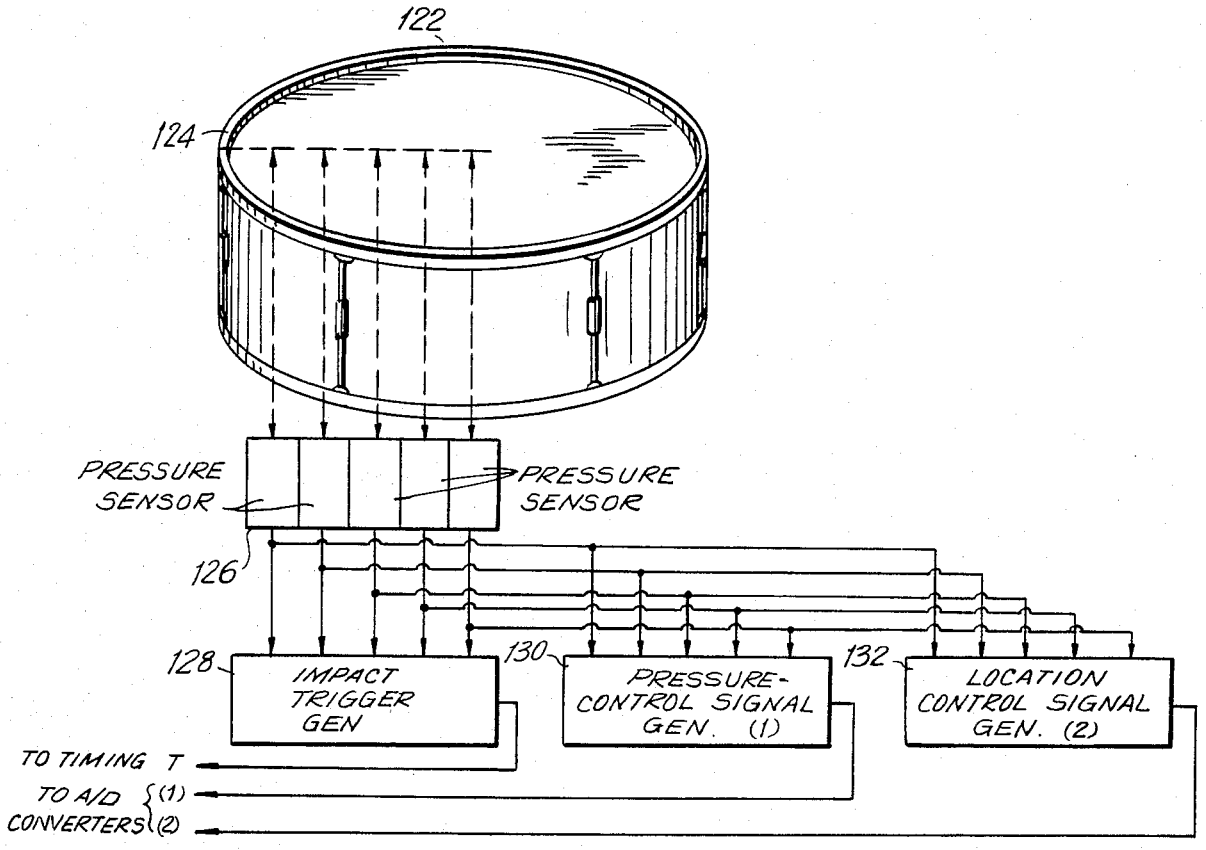
DRUM INPUT DEVICE
FIG. 6

INTERACTIVE MUSIC COMPOSITION AND PERFORMANCE SYSTEM

BACKGROUND OF THE INVENTION

This invention relates to electronic music systems, and more particularly relates to a method permitting interactive performance of music generated by an electronic music device. This invention is more specifically directed to synthesizer or computer-generated music, especially automatic or semiautomatic digital generation of music by algorithm (i.e., by computer program).

In the recent past, there have been proposed music generating systems, to be comprised of a digital computer and a music synthesizer coupled thereto. In performing typical such systems, the generated music is determined entirely by the user of the system, playing the role of performer or composer. The user first determines the nature of the sounds of the system produces by manipulating a plurality of controls, each associated with one or more parameters of the sound. Once the sounds are determined, the user performs music with the system in the manner of a traditional musical instrument, usually by using a piano-type keyboard.

A major problem with the traditional approach to music as applied in the above-mentioned systems, is that it requires a considerable technical knowledge of sounds that are produced and varied electronically. Another problem is that such systems produce each sound only in response to external stimuli (i.e., acts performed by the user of the system), thereby limiting the complexity of the system's output to what the user is capable of performing. Still another problem is that the relationship between the system and user is limited to the type of functioning typical of a traditional musical instrument, so that the user can relate to the system only as a performer relates to his or her instrument. A further problem is that the peformance device employed by the user is normally a fixed part of the system, and is not interchangeable with other peformance devices.

Previous systems have not automatically generated sounds, music, or performance information, while allowing a performer to interact with and influence the course of the music. No previous system designed for performance could be used effectively by a performer or user not having previously learned skills, such as those required to play a keyboard instrument.

OBJECTS AND SUMMARY OF THE INVENTION

Accordingly, it is an object of this invention to provide a technique for the interactive control of synthesized or computer generated music. The technique is interactive in the sense that a listener or operator can direct the system's production of music in response to those aspects of the music automatically generated by the system in response to the music as he or she hears the music being played.

It is another object of the present invention to provide such a music generating technique in which the music played by the system is generated automatically, while some aspects of the music played by the system can be altered by human input on a performance device associated with the system.

It is a further object of the present invention to provide a method for producing music using a computer, a music synthesizer, and a performance device associated with the computer permitting user control of at least certain aspects of the automatically produced music.

An interactive performance system according to this invention may be realized in any of a wide diversity of specific hardware and software systems, so long as the hardware for the system includes a synthesizer, a programmable computer coupled to the synthesizer and capable of storing and running the software, and at least one performance device for providing, as a user performance input, one or more signals in response to a physical act performed by the user; and the software includes algorithms (1) for interpreting performer input as controls for music variables, (2) for automatically generating controls for music variables to be used in conjunction with controls specified by the performer, (3) for defining the music composing variables operative in a particular composition and interpreting controls in light of them, (4) for interpreting music composing controls in light of sound-generating variables, and (5) for automatically generating controls for sound variables to be used in conjunction with the other controls.

The method according to this invention is carried out by interpreting a performer's actions as controls and/or automatically generating controls, and interpreting those controls in light of composition and sound variables and further interpreting them in light of synthesizer variables and applying them to control sound production in a synthesizer. Audible musical sounds from the synthesizer are provided as feedback to the performer or user.

The hardware (i.e., the synthesizer and computer) should be capable of real time musical performance, that is, the system should respond immediately to a performer's actions, so that the performer hears the musical result of his or her action while the action is being made. The hardware should contain a real-time clock and interrupt capability. The term "real-time" is used in the specification and claims to describe an electronic system that composes music by calculating musical data while it is generating sound. Real-time composition and performance takes place even where the music contains non-predeterminable aspects to which the human performer responds while interacting with the system.

A key aspect of this invention is that the music is composed and the sound produced in real time while the performer is interacting with the system; i.e., the music is being composed with the resulting sound being produced at the same time, and the performer hears the music and influences it.

The performance device can be of any type, including a keyboard, joystick, proximity-sensitive antennas, touch sensitive pads, or virtually any other device that converts a physical motion or act into usable information.

The software (i.e., the sound algorithm, composing algorithm, performance algorithm, and control algorithms) determines control data for the sound-generating variables in such a way that the system composes and performs music automatically with or without human performance. The control data may be generated by the reading of data tables, by the operation of algorithmic procedures, and/or by the interpretion of performance gestures.

In one embodiment, data functioning as a musical score are generated by a composing algorithm and automatically determines such musical qualities as melody, harmony, balance between voices, rhythm, and timbre; while a performance algorithm, by interpreting a performer's actions and/or by an automatic procedure, controls tempo and instrumentation. A user can perform the music by using joysticks, proximity-sensitive antennas, or other performance devices.

In another embodiment, the computer-synthesizer system functions as a drum which may be performed by use of a control device in the form of a touch-sensitive pad. A composing algorithm initiates sounds automatically and determines timbre, pitch, and the duration of each sound, while the performer controls variables such as accent, patterns, and patterns sound-type.

Interactive music performance systems employing the principles of this invention are not, of course, limited to these embodiments, but can be embodied in any of myriad forms. However, for the purpose of illustrating this invention, a specific embodiment is discussed hereinbelow, with reference to the accompanying drawings.

BRIEF DESCRIPTION OF THE DRAWINGS

FIGS. 5 and 6 are schematic illustrations of a hand-proximity input device and a drum input device for use with this invention.

DETAILED DESCRIPTION OF THE PREFERRED EMBODIMENTS

Figure 1:
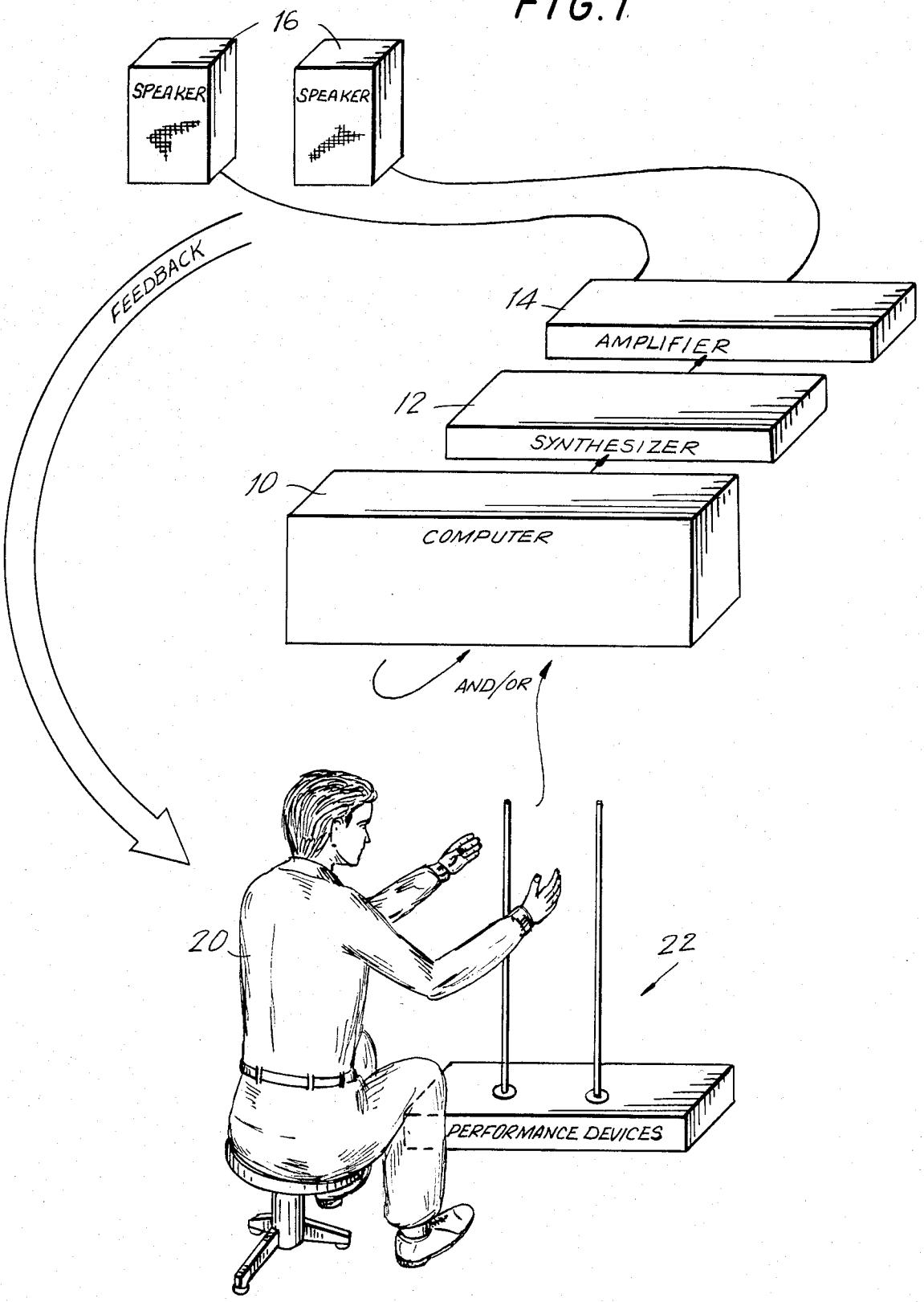
FIG. 1 is a diagram of the system, which includes a performance device, a computer and a synthesizer arranged according to this invention.

FIG. 1 illustrates the functional relationships of elements of this invention including a computer 10 capable of storing and running a program containing a performance algorithm for interpreting a performer's actions as controls for music variables, composing and sound algorithms for processing controls in terms of music and sound variables, and automatic control generating algorithms. The control data generated in and processed by the computer 10 are provided to a synthesizer 12 to determine the characteristics of musical sounds, and such sounds are amplified in an amplifier 14 and fed to one or more loudspeakers 16 to play the music. The music serves as feedback to a human user 20, who can interact with the computer 10 by actuating a performance device or devices 22. The latter can be any of a wide variety of devices capable of providing information to the computer, but in this case the devices are proximity sensitive antennas. The user 20 can change the position of his or her hands in relation to the performance device 22 upon hearing music output from the synthesizer 12.

Figure 2:
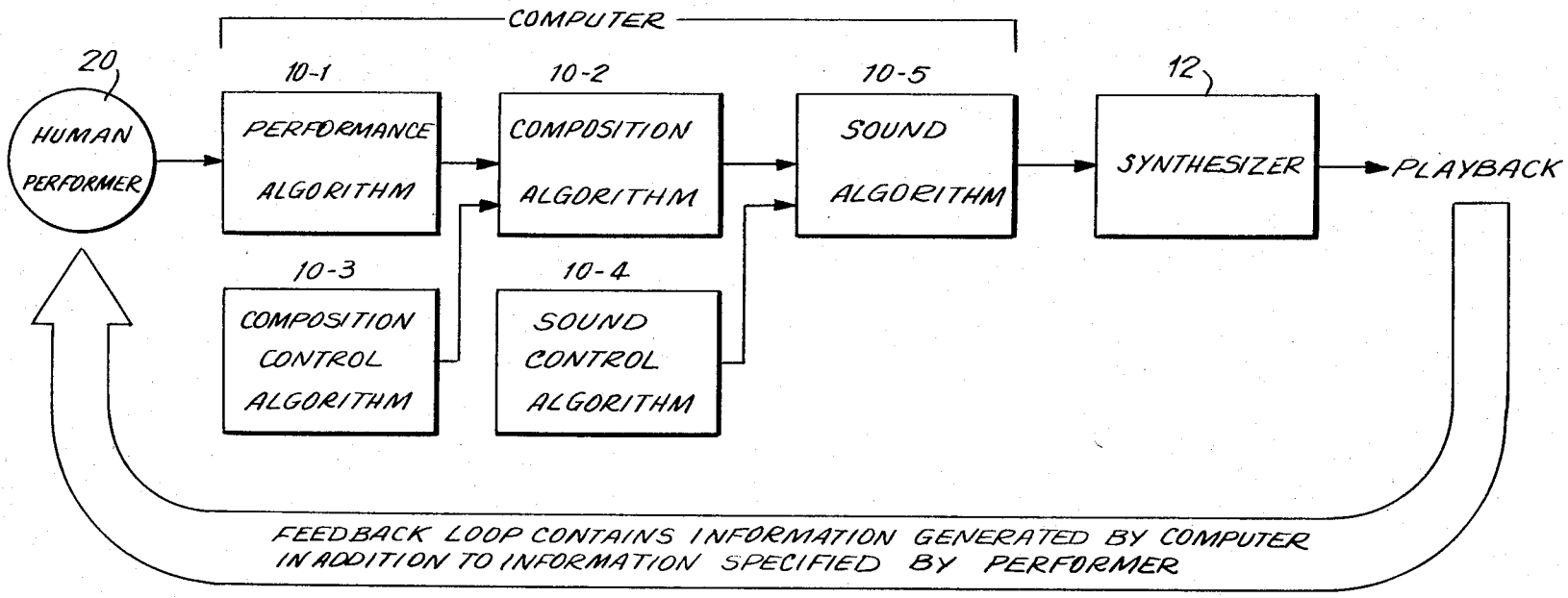
FIG. 2 is a block diagram illustrating the functioning of the system.

FIG. 2 schematically illustrates the generation of music as carried out by the computer 10 in connection with the synthesizer 12. The computer 10 stores a performance algorithm 10-1 which scans for performance action by the human performer 20 and, if these actions are present, interprets the performance actions as controls for the variables defined in the composition algorithm 10-2. At the same time, a composition control algorithm 10-3 generates additional controls for variables defined in the composition algorithm 10-2 which are not controlled by the performer. The composition algorithm 10-2, which defines the music variables operative in a particular composition, interprets the controls applied to it in light of those variables, and applies those controls, in conjunction with additional controls generated by a sound control algorithm, to determine values for sound variables as they are defined in a sound algorithm 10-5. As a result of the latter, the computer furnishes sound controls to the synthesizer 12, which generates sound. The sound itself (i.e., the synthesized music) conveys information generated by the computer 10 in addition to information specified by the performer 20.

The result of the interaction of the computer 10 and the performer 20 is a "conversation" between the computer and the performer. That is, although the performer 20 may not know precisely what musical notes are going to be generated, by responding with his or her own gestures to music that is produced by the synthesizer 12, he or she is able to control the general direction of the performance of the composition. A useful analogy is to a conversation or discussion; a discussion leader does not know what another person is going to say, but he or she, knowing the direction the conversation is to go, can steer the conversation by framing responses to the other person's remarks.

In a favorable embodiment of this invention, the computer is programmed in XPL, as shown in simplified form in Table I. In this program, the composition algorithm interprets a performer's actions as controlling duration and determining which instrumental voices are playing, and interprets controls from the composition control algorithm as determining changing volume of each sound which is heard in the aggregate as a changing balance between voices, and the changing duration of each note which is heard as rhythm.

The program begins with statements of initial values. Lines 3–8 list the frequencies of the basic "keyboard" used by the voices as a reference for pitches. Lines 10–11 show values used later in the program (lines 172–173) for changing note durations. Line 13 sets initial values for the melody algorithm. Lines 17–32 show the random (i.e., pseudorandom) number algorithm used to make decisions throughout the programl. Line 22 sets the initial values for the variables "nowfib," "fibm1," and "fibm2." Lines 23–27 show that each occurrence of "nowfib" is the sum of its two previous values, stored as "fibm1" and "fibm2". In line 28, the most significant bit of "nowfib" is cleared, leaving "num" as the resultant number. This number "num" is then divided by the difference between the minimum and maximum limits of a specified range, and the remainder from the quotient is then added to the minimum limit of the range. For example, if a user specifies a random number to occur between 9 and 17, "num" will be divided by 8 (i.e., the difference between 17 and 9) and the remainder from that division will be added to 9. The variable "tum" contains the value of the resulting number, and is returned to the program as an argument. Lines 36–41 are a subroutine for sampling analog-to-digital converters associated with the performance device or devices 22, by means of which the analog output voltage from the device 22 is converted to a number suitable for use in this program. Lines 45–49 are the real-time clock interrupt service routine. The clock is set in line 47 to interrupt the program at centisecond intervals, at which times the variable "time" is decremented by one, thereby allowing the program to count centiseconds.

Lines 51 to 176 constitue a continuously executing loop of the program, with the program between lines 54 and 174 executing when the variable "time" is decremented to zero. If the program is operating in a manual performance mode, which occurs when the variable "auto" is set to zero (which can be done by any means, such as typing a character on a terminal keyboard), lines 56–69 are executed, thereby causing the analog-to-digital converters to be sampled via a subroutine call, and the resulting values are set for the variables "spd" and "zon1". If the program is operating in an automatic performance mode, which occurs when the variable "auto" is set to one, the random number algorithm sets the values for "spd" and "zon1".

Figure 3:
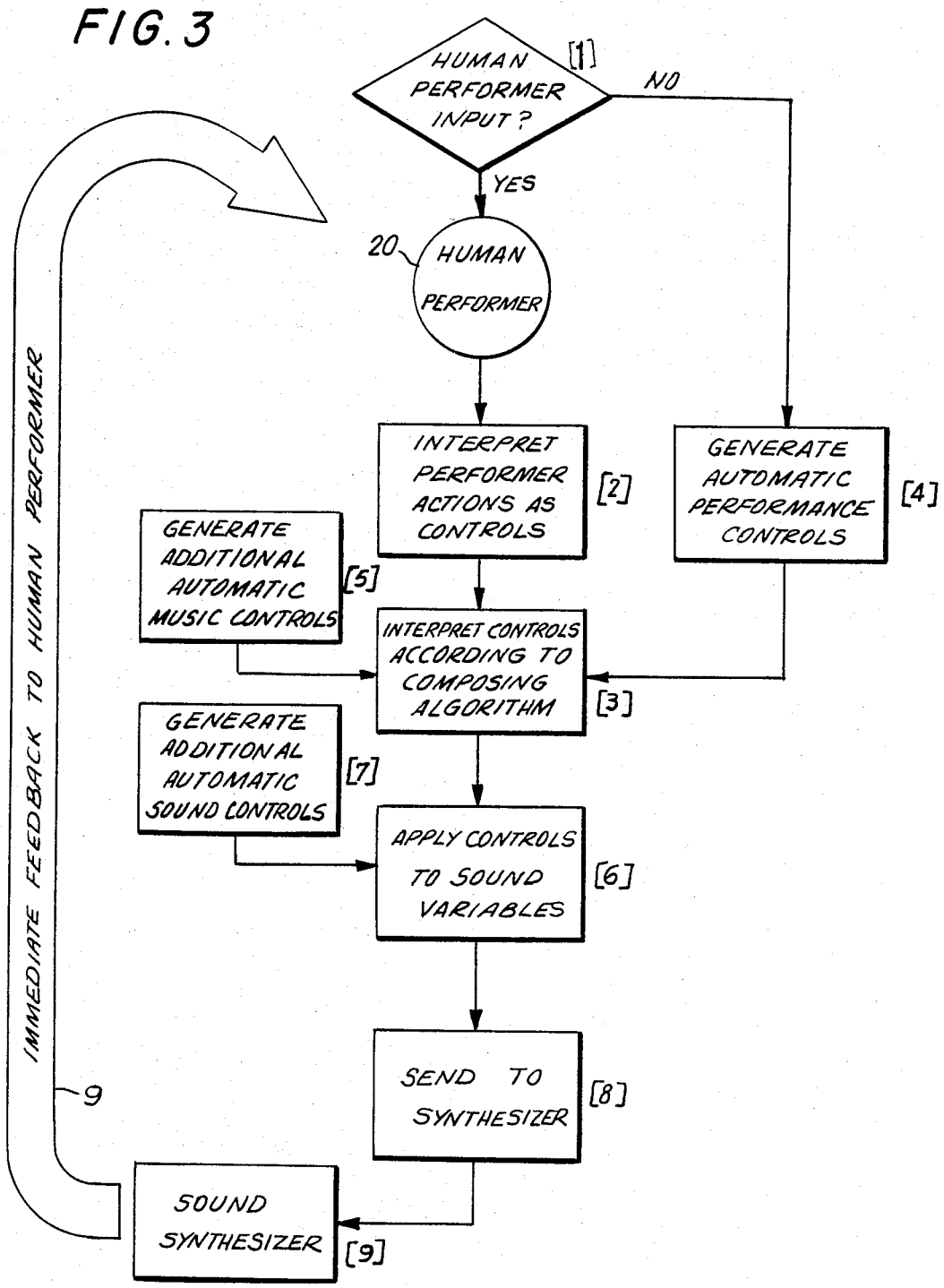
FIG. 3 is a flow chart illustrating the general principles of the method according to this invention.

The interactive performance technique of this invention can be thought of as operating in accordance with the flow chart illustrated in FIG. 3. If there is determined to be a human performer input (step [1]), the performance algorithm is set to interpret the signal from the performance device 22, as shown in step [2]. Then, the composing algorithm interprets the control output from the performance algorithm, as shown in step [3]. However, if in step [1] there is determined to be no human performer input, the program proceeds to an alternate function of the performance algorithm as in step [4], and the performance controls in lieu of a human performer are generated automatically. Additional automatic music controls are provided as shown in step [5].

As shown in step [6], the sound algorithm interprets controls provided by the composing algorithm, and furnishes those controls to the synthesizer 12. Additional automatic sound controls are generated, as shown in step [7], and these are furnished to control additional sound variables in the routine of step [6].

Thereafter, as shown in step [8], sound variables are furnished to the synthesizer 12 which generates musical sound, as shown in step [9], and sound is produced from the loudspeakers 16 as immediate feedback 9 to the human performer 20.

Then, upon hearing this music feedback 9 the human performer can adjust the position of his or her hands to change the way that the music is being played.

Figure 4:
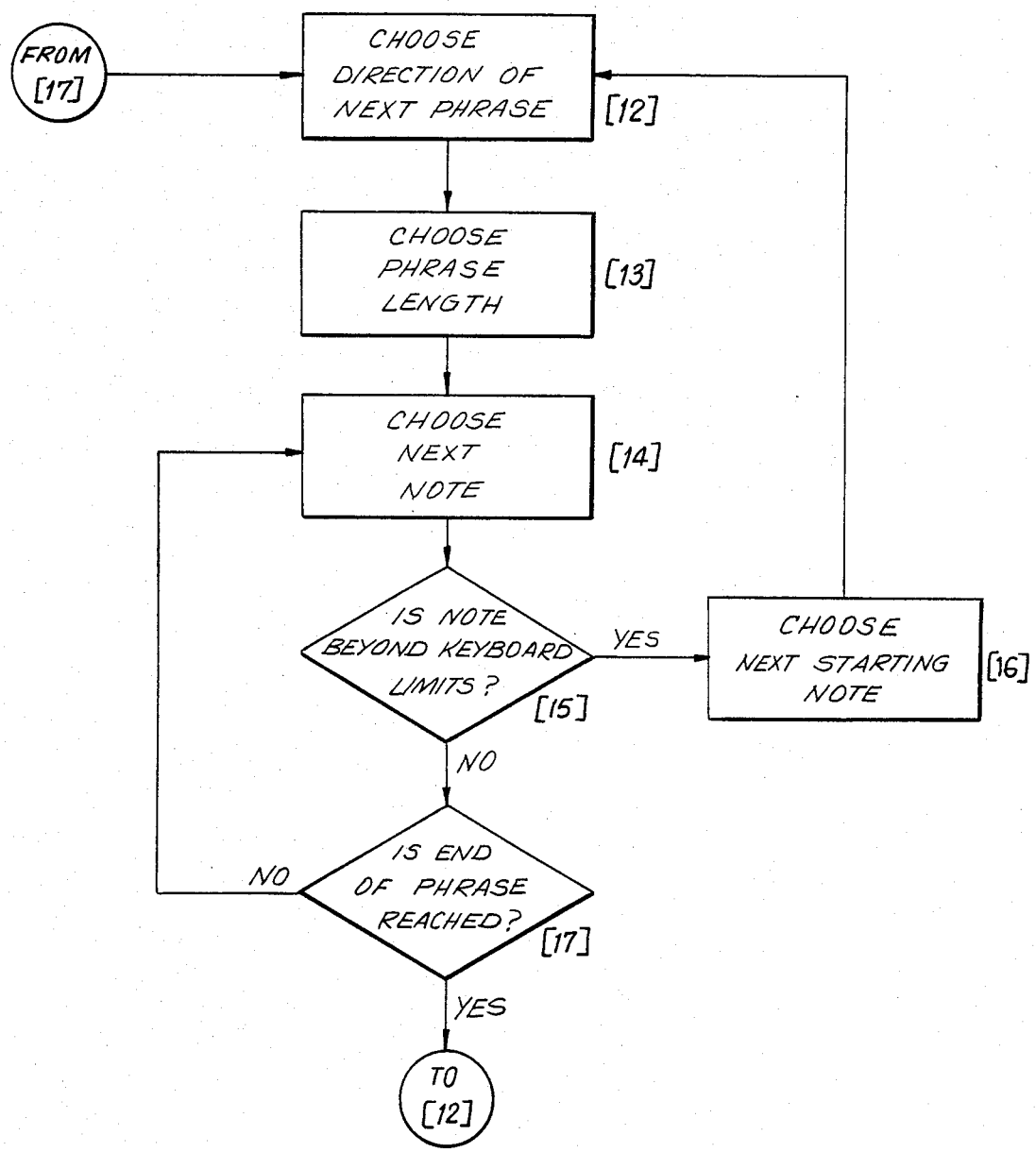
FIG. 4 is a flow chart of a melody algorithm according to this invention.

FIG. 4 shows a flow chart of the melody algorithm as stated in lines 99–108 of the program in Table I. In blocks [12], [13], and [14], the direction of the next phrase, the length of that phrase, and the interval to the next note (which determines the note) are chosen according to a pseudorandom number algorithm. Then, as shown in decision step [15], if the note selected in block [13] exceeds the "keyboard" limits of the program, the algorithm proceeds to step [16], where a new starting note is selected and thereafter the algorithm returns to step [12]. However, if the note is not beyond the "keyboard" limit, the algorithm proceeds to step [17]. Then, the next note is selected according to the routine of step [14], until the end of the particular phrase is reached, whereupon the melody algorithm returns to block [12].

As shown in lines 119 to 168 of Table I, the choice of note can be at, above, or below the melody note, which thereby determines the note content of a chord. These lines also determine the volume level for each voice, first according to the value of the variable "zon1", and then according to the pseudoranom number algorithm.

Lines 188–190 operate to calculate the value for the duration of each note, according to the value of the variable "spd" in conjunction with the pseudorandom number algorithm.

A typical arrangement of a pair of hand-proximity input devices for use with this embodiment is shown in FIG. 5. Here, each of the wand-like proximity sensors 22L and 22R has associated with it a capacitance-to-frequency converter 24, 25, followed by a frequency-to-level converter 26, 27, which is in turn followed by an analog-to-digital converter 28, 29.

A second embodiment of this invention employs a performance device in the form of a touch pad 122 having a drum-head-type material 124 on the top surface thereof. A plurality of pressure sensors 126 which can be piezoceramic transducers determine the pressure applied to the drum head 124 at a plurality of locations thereon. Each of these pressure sensors 126 has its outputs connected to an impact trigger generator 128, and a sample-hold circuit 130, which respectively provide an impact trigger (T), and a pressure signal (1). A location signal (2) is generated in a capacitance sensing system 132 linked to the drum head 124. The trigger (T) is initiated each time the human performer 20 strikes the drum 122 with his hand. The control signal (1) varies in proportion to the pressure with which the drum 122 is struck, and the control signal (2) varies in accordance with the location of impact of the human performer's hand on the drum head 124.

The computer program for this embodiment of the interactive music performance technique is written in XPL, and a portion of that computer program is shown in Table II. This section of the computer program determines how musical variables are controlled in two different modes of operation. In a manual operating mode, the peformer initiates each sound and controls accent and timbre; in an automatic operating mode, the initiation of each sound is automatic, and the performer controls accent, speed, and timbre by striking the drum 124.

In this program, line 3 is a subroutine call which tests the value of an analog-to-digital converter to determine if the drum 122 has been struck. In line 4, the variable "sam" is set to 1 to prevent the computer from repeatedly sensing the same impact, and the variable "sam" is set to 0 in line 28 when the impact of the drum strike has sufficiently decayed to differentiate each strike from the next.

In lines 6–9, the "pressure" output from the drum is sampled, and a corresponding value is assigned to the variable "zonk". In lines 11–13, the "location" output from the drum is sampled and a corresponding value is assigned to the variable "place". In lines 18–19, this algorithm interprets the performance information in a manual operating mode. The variable "gon" is set to 1 which initiates sound when the variable "tim (100)" is decremented to zero in line 38. The variable "zonk" determines the amount that the sound will be accented. In lines 45 and 50, the value of "place" determines which of the two sound types will be generated. Lines 22–23 interpret the performance information in automatic operating mode. The variable "accent" is set to 8 each time the drum is struck, thereby causing an accent. The value of the variable "zonk" determines the sound type which will be heard. Lines 30–34 generate timed triggers for the automatic drum sound, and the value of the variable "place", in line 31, determines the speed of repetition of the triggers. Finally, lines 43–57 show how the variables "accent", "vol", and "loud" are used to cause accents.

Figure 7:
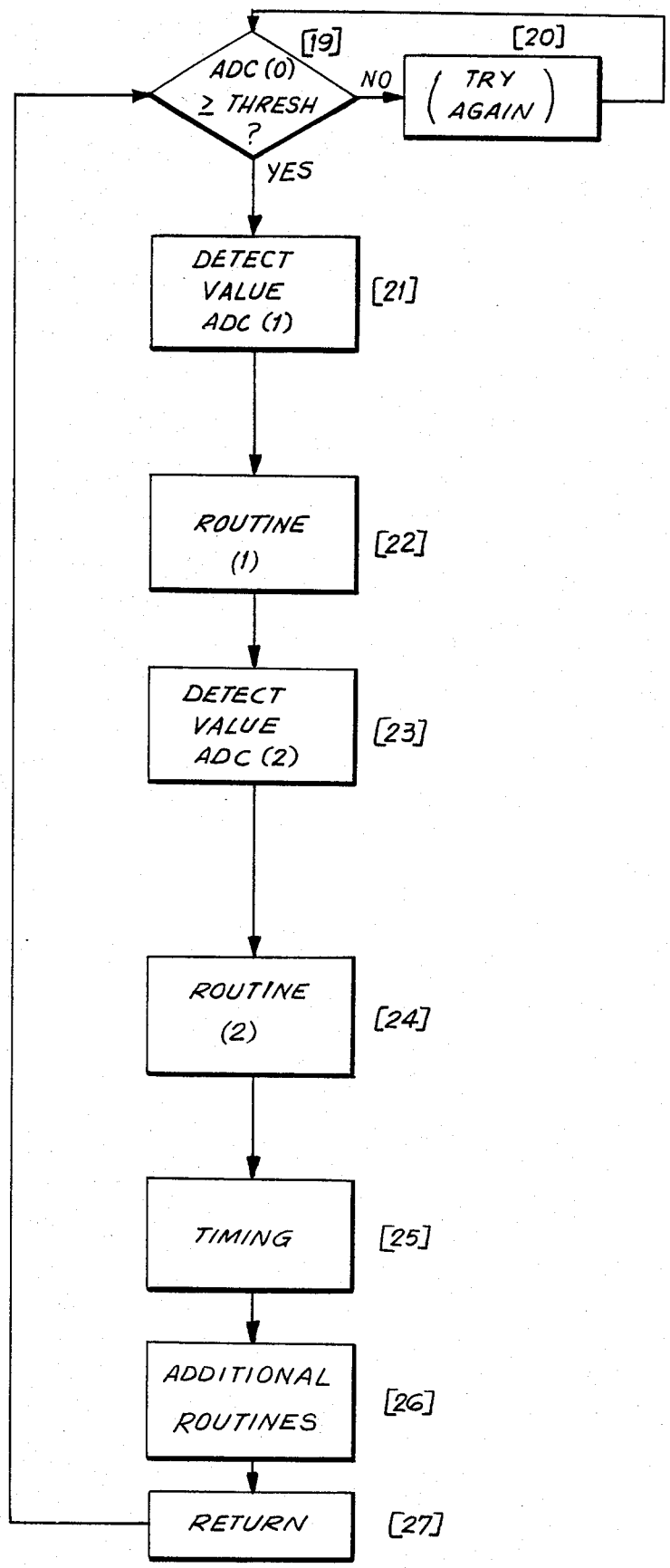
FIG. 7 is a flow chart of the performance algorithm according to one embodiment of this invention.

The general principles of this method can be readily explained with reference to the flow chart of FIG. 7. Initially, the signal level at adc(0) is determined in step [19]; if it does not exceed the predetermined threshold, there is no initialization of sound in manual mode and no input of controls in auto mode. The routine periodically repeats scanning the signal at adc(0) as shown in step [20]. However, if the signal level at adc(0) does exceed the threshold, then the signal level at adc(1), is determined in step [21], and applied in step [22] to control a musical variable.

Thereafter, the signal level at adc(2) is detected in step [23], and then, in step [24], the control for a second musical variable is determined based on this value.

A timing routine [25] precludes multiple actuations of the drum 122 from generating undesired changes in the music variables. Then, additional necessary routines for producing music are carried out (step [26]) and the algorithm ultimately returns (step [27]) to the beginning.

While specific embodiments of this invention have been described hereinabove, many further possible embodiments will become apparent to those of ordninary skill in the art.

For example, this invention could be employed for the playing of a well known musical score, such as Brahms' Fourth Symphony, in which the user can "conduct" the score by supplying decisions as to rhythm, loudness, relative strength of various instrument voices, and other variables normally associated with conducting a musical work, by input with a performance device.

In many possible embodiments, the peformer or user can use proximity-sensitive antennas, a joystick, piano-type keyboard, touch pad, terminal keyboard, or virtually any other device which can translate a human movement into usable information.

In other embodiments, controls for music and/or sound variables can be provided by a pseudorandom number generator, or any other appropriate algorithm, rather than follow any pre-programmed scheme.

In further embodiments, controls for music and/or sound variables can be provided in accordance with the human performer's interaction with an additional performance device, while his or her interaction with the first performance device 22 or 122, or any other performance device, controls the above-mentioned conducting variables.

Many further modifications and variations will make themselves apparent to those skilled in the art without departing from the scope and spirit of this invention, as defined in the appended claims.

TABLE I

```
/***** initialization *****/

dcl notes data (65,69,73,78,82,87,92,98,
104,110,117,123,131,139,
147,156,165,175,185,196,208,220,233,247,262,277,294,
311,330,349,370,392,415,440,466,494,523,554,587,622,
660,698,740,784,831,880,932,988,1047,1109,1175,
1245,1319,1397,1475,1568);

dcl durat data (1,2,3,1,1,2,3,1,1,1,1,1,11,8,1,2,5,
1,1,1,1,1,1,2,3,21,1);

phrase=7; n=22;

/***** subroutine:random number generator *****/

rand:procedure (man,mix) fixed;
```

TABLE I-continued

```
dcl (man,mix) fixed;
dcl (nowf1b,fibm1,f1bm2,num) fixed;
dcl (mum,tum,lum) fixed;
if nowfib=0 then do;
nowfib=2; fibm1=1; fibm2=1;
end;
else do;
fibm1=nowfib;
nowfib=nowfibm+fibm2;
fibm2=fibm1;
num=nowfib & "077777";
end;
tum=man+(num mod (mix-man));
return tum;
end;

/***** subroutine:sampling analog-to-digital
converter *****/

adc:procedure(cnum);
declare cnum fixed;
write ("12")=cnum;
do while ("13")=1; end;
return read ("12");
end;

/***** clock interrupt routine *****/

when d16int then begin;
time=time-1;
write ("16")=999;
return;
end;

/********** continuing program loop **********/

do while 1=1;
if time<=0 then do; /*- begin timing -*/

if auto=0 then do; */- human performer -*/

thresh=0; zon=0;
do while thresh<=adc(0);
thresh=thresh+500; zon=zon+1;
spd=rate(zon);
end;

thresh1=1000; zon1=0;
do while thresh1<=adc(1);
thresh1=thresh1+350; zon1=zon1+1;
end:

end;
else do; /*- auto performer -*/

tempo=rand(0,100);
if tempo<75 then zon=2;
else do;
if tempo>85 then zon=9;
if tempo>75 and tempo<85 then zon=3+rand(0,6);
end:
spd=rate(zon);

if zon<=2 then zonk=2; else zonk=zon;
do case zonk;
;
;
ref=65;
ref=50;
ref=45;
ref=40;
ref=30;
ref=20;
ref=15;
ref=10;
;
end;
color=rand(0,100);
if color>ref then zon1=rand(3,10); else zon1=2;

end;
```

TABLE I-continued

```
if phraz>=phrase then do; */- basic melody -*/
updown=rand (0,100);
phrase=rand(3,11);
phraz=0;
end;
phraz=phraz+1;
interv=rand(1,7);
if updown>45 then n=n+interv;
else n=n-interv;
if n>55 or n<0 then n=rand(15,28);

voice1=n+rand(1,11);          /*- note & volume:voice1 -*/
if voice1>50 then voice1=rand(10,50);
freq1=notesvoice1);
if zon1<=4 or zon1>6 then vol1=0;
else vol1=rand(90,180);
if zon1>=9 then vol1=rand(90,180);

(send to synthesizer)

voice2=n+rand(1,11);          /*- note & volume:voice2 -*/
if voice2>50 then voice2=rand(10,50);
freq2:notes(voice2) ;
if zon1<=6 then vol2=0;
else vol2=rand(100,255);

(send to synthesizer)

voice3=n+rand(1,7);           /*- note & volume: voice3 -*/
if voice3>55 then voice3=rand(0,55);
freq3=notes(voice3);
if zon1>=3 and zon1<=6 then vol3=rand(90,180);
else vol3=0;
if zon1>=9 then vol3=rand(90,180);

(send to synthesizer)

voice4=n+rand(1,11);          *- note & volume:voice4 - */
if voice4>50 then voice4=rand(10,50);
freq4=notes(voice4)
if zon1<=6 then vol 4=0;
else vol4=rand(100,255)

(send to synthesizer)

voice5=n;                     /*- note & volume:voice5 -*/
if voice5<8 then voice5=rand(,45);
freq5=notes(voice5);
vol5=rand(190,255);

(send to synthesizer)

voice6=n;                     /*- note & volume:voice6 - */
if voice6>50 or voice6<12 then voice6=rand(22,40);
freq6=notes(voice6);
vol+rand(190,255)

(send to synthesizer)

voice7=n+rand(1,11);          /*- note & volume:voice7 -*/
if voice7>50 then voice7=rand(22,50);
freq7=notes(voice7);
vol7=rand(140,210);

(send to synthesizer)

voice 8=n-rand (1,11);        /*- note & volume:voice8 -*/
if voice 8<12 then voice8=rand(22,45);
freq8=notes(voice8);
vol8=rand(140,210);

(send to synthesizer)

d0=rand(0,26);
w=spd+durat(d0);
time=w*8;
end;
end;
```

TABLE II

```
/*- triggers for notes -*/

if adc(0)>3500 and sam=0 and gon=0 then do;
/*- hit=hits or accts -*/
sam=1;

thres=0; zonk=0;      /*- pressure=accts or timb -*/
do while thres<adc(1);
thres=thres+500; zonk=zonk+1;
end;

thresh=0; place=0;      /*- place=timb or spd -*/
do while thresh<=adc(2);
thresh=thresh+500; place=place+1;
end;

do case auto;
do;
gon=1; accent=zonk;
if place<3 then sound=0; else sound=1;
end;
do;
accent=8;
if zonk<4 then sound=0; else sound=1;
end;
end;

end;
if adc(0)<2500 and sam=1 then sam=0;

if tim(99) <=0 and goon=0 then do;
/*- autodrum timing -*/
if auto=1 then do; goon=1; dur=place; end;
else do; goon=0; dur=8; end;
tim(99)=rhy1(dur);
end;

/*- note triggered? -*/

if tim(100)<=0 and (gon=1 or goon=1) then do;
gon=0; goon=0;

/*—determine sound and mc ration —*/

do case sound;
do;     /*- deep drum -*/
if accent>4 then vol=1;
else vol=0;
accent=0;
end;
do;     /*- fast light drum -*/
if accent>5 then vol=1;
else vol=0;
end;
end;

if vol=0 then loud=rand(40,180);
else loud=rand(110,255);

(send to synthesizer)
```

What is claimed is:

1. Interactive method of generating music employing a synthesizer; a programmable computer coupled to said synthesizer and capable of storing and running a program containing a music and sound control algorithm for generating music and sound control data in real time to be provided to said synthesizer and a performance algorithm for generating and interpreting performance control data; and at least one human-performer input device producing a signal in response to a physical music-performing gesture by a human performer; comprising the steps of:

generating said music and sound control data in said computer to produce an ongoing, real-time, at least partially non-predeterminable musical composition;

automatically supplying said music and sound control data from said computer to said synthesizer in accordance with said performance algorithm;

scanning the signal from said human-performer input device at periodic intervals to determine whether said human performer is performing said gesture;

if said signal indicates occurrence of said music-performance gesture, then altering said automatic performance algorithm in accordance with said signal and supplying said performance control data according to the altered performance algorithm; and producing audible music from said synthesizer, as determined by said performance, music, and sound control data, as audible feedback to said performer.

2. Interactive method of generating music according to claim 1; wherein said performance algorithm includes a pseudorandom number generator subroutine, and decisions concerning generation of said performance control data are carried out by said subroutine when said signal indicates the non-occurence of said music-performing gesture.

3. Interactive method of generating music according to claim 1; further comprising altering said music and sound control data in accordance with the signal produced in said device, if the scanned signal indicates the occurrence of said music-performing gesture.

4. Interactive method of generating music employing a synthesizer; a programmable computer; and at least one performance device; said synthesizer, computer, and device operating together as a real-time composing and sound-producing system operative with a human performer, the method comprising the steps of:

automatically generating composition control data in said computer, which composition control data determine in real time the course of an ongoing musical composition such that aspects of the music are non-predeterminable;

applying these composition control data to the synthesizer to affect the latter's operation;

generating sound in the synthesizer in accordance with the composition control data applied to it;

generating performance control data in the performance device in response to control gestures of the performer with the device; and applying said performance control data to said computer to control at least certain aspects of the musical composition in conjunction with the composition control data that are automatically generated in the computer, such that the performer can influence the course of the ongoing musical composition by selecting his or her next peformance gesture in response to the aspects of the generated music determined by the composition control data automatically generated by the computer.

5. Interactive method of generating music according to claim 4; wherein said automatically generated composition control data control pitch, harmony, rhythm, and balance between voices; while said performance control data determine temp and timbre.

6. Interactive method of generating music according to claim 4; wherein said performance device includes a hand-capacitance sensor, and said performance control data are generated by varying the proximity of a portion of the performer's body to said sensor.

7. Interactive method of generating music according to claim 4; wherein said performance device includes a touch-sensitive plate for generating a first control signal on impact and other control signals in accordance with the position on said touch-sensitive plate where the impact occurs; said other control signals being generated on impact.

8. Interactive method of generating music according to claim 4; wherein said programmable computer includes pseudorandom number generator means for generating said performance control data in the absence of said performance gestures of the performer.

9. Interactive method of generating music according to claim 4; further comprising, in the case of non-occurrence of a control gesture by said performer, automatically generating said performance control data.

10. Interactive music generation and performance apparatus comprising at least one performance device; a synthesizer; and a programmable computer; said device, said synthesizer, and said computer operating together as a real-time performing and composing system both with and without a human peformer; wherein said performance device includes means for generating performance control data, if the performer is present, in response to control gestures of the performer with the device; wherein said synthesizer includes means for generating sound in accordance with composition control data applied to it; and wherein said programmable computer includes (1) means for automatically generating said composition control data in real time, which composition control data determine the course of an ongoing musical composition with non-predeterminable aspects, (2) means for applying these composition control data to the synthesizer to affect the latter's operation, (3) means for applying said performance control data to said composition control data generating means to influence at least certain aspects of the ongoing musical composition in conjunction with the composition control data that are being automatically generated, such that the performer can affect the course of the ongoing musical composition by selecting his or her next performance gesture in response to the aspects of the generated music determined by the composition control data automatically being generated, and (4) means for automatically generating said performance control data in the absence of any performance gesture of the performer so that the composition is produced automatically even in the absence of a control gesture executed by a performer.

11. Interactive music generation and performance apparatus according to claim 10; wherein said automatically generated composition control data control pitch, harmony, rhythm, and balance between voices; while said performance control data determine tempo and timbre.

12. Interactive music generation and performance apparatus according to claim 10; wherein said performance device includes a capacitance sensor, and said performance control data are generated by varying the proximity to said sensor of a portion of the performer's body.

13. Interactive music generation and performance apparatus according to claim 10; wherein said means for generating said composition control data in real time includes pseudorandom number generator means.

14. Interactive music generation and performance apparatus according to claim 10; wherein said means for automatically generating said performance control data in the absence of any performance gesture includes pseudorandom number generator means for generating said performance control data in the absence of said performance gestures.

* * * * *